US009314116B2

(12) United States Patent
Bell

(10) Patent No.: US 9,314,116 B2
(45) Date of Patent: Apr. 19, 2016

(54) BABY CARRIER SWING CONVERSION SUPPORT DEVICE

(71) Applicant: Henry J. Bell, Cincinnati, OH (US)

(72) Inventor: Henry J. Bell, Cincinnati, OH (US)

( * ) Notice: Subject to any disclaimer, the term of this patent is extended or adjusted under 35 U.S.C. 154(b) by 28 days.

(21) Appl. No.: 14/328,255

(22) Filed: Jul. 10, 2014

(65) Prior Publication Data

US 2016/0007767 A1 Jan. 14, 2016

(51) Int. Cl.

| | |
|---|---|
| ***A47D 7/00*** | (2006.01) |
| ***A47C 7/00*** | (2006.01) |
| ***A47D 13/10*** | (2006.01) |
| ***A63G 9/12*** | (2006.01) |
| ***A47D 13/02*** | (2006.01) |

(52) U.S. Cl.

CPC ..... *A47D 13/105* (2013.01); *A47D 13/025* (2013.01); *A63G 9/12* (2013.01)

(58) Field of Classification Search

CPC .... A47D 13/105; A47D 13/02; A47D 13/025
USPC ..... 5/101, 102, 103, 105, 106, 107, 108, 5/109, 93.2, 99.1; 297/183.3, 186, 255, 297/259.2, 259.3, 260.2; 248/165, 166, 248/170, 105

See application file for complete search history.

(56) References Cited

U.S. PATENT DOCUMENTS

| | | | | | |
|---|---|---|---|---|---|
| 258,198 | A * | 5/1882 | Fitzwater | A47D 9/005 | 5/102 |
| 751,125 | A * | 2/1904 | Wertz et al. | A47D 9/02 | 185/38 |
| 3,256,016 | A * | 6/1966 | Berlin | A47D 13/105 | 248/163.2 |
| 4,324,432 | A * | 4/1982 | Eldon, III | A47D 13/105 | 297/377 |
| 5,511,258 | A * | 4/1996 | Barr, Sr. | A47D 9/00 | 297/273 |
| 5,531,656 | A * | 7/1996 | Varghese | A63G 9/00 | 297/274 |
| 5,617,594 | A * | 4/1997 | Chien | A47D 1/02 | 5/101 |
| 5,987,665 | A * | 11/1999 | Simantob | A47C 9/002 | 297/273 |
| 6,386,986 | B1 * | 5/2002 | Sonner | A47D 13/105 | 297/273 |
| 7,037,205 | B1 * | 5/2006 | Bowman | A47D 13/105 | 297/183.1 |
| 7,445,560 | B2 * | 11/2008 | Greger | A47D 13/102 | 297/273 |
| 7,861,337 | B1 * | 1/2011 | Patel | A47D 9/02 | 5/101 |
| 8,550,927 | B2 * | 10/2013 | Hunter-Jones | A47D 13/105 | 472/119 |
| 8,795,097 | B2 * | 8/2014 | Chapman | A47D 13/105 | 472/119 |
| 2007/0060405 | A1 * | 3/2007 | Grossman | A47D 13/105 | 472/125 |
| 2010/0123341 | A1 * | 5/2010 | Furman | B60N 2/2845 | 297/217.4 |
| 2011/0012394 | A1 * | 1/2011 | Furman | A47D 13/02 | 297/183.1 |
| 2011/0041245 | A1 * | 2/2011 | Shafer | A47D 9/02 | 5/108 |

* cited by examiner

*Primary Examiner* — Terrell McKinnon
*Assistant Examiner* — Michael McDuffie

(57) ABSTRACT

A baby carrier swing conversion support device supports an existing baby carrier in a position over a supporting surface while allowing the carrier to swing. The device includes a bar having opposite ends. Each of a pair of supports is coupled to an associated one of the opposite ends of the bar for hanging an infant carrier from the bar between the supports. The supports and the bar define a stand. Each of a pair of hooks is coupled to and extends from the bar for receiving a handle of the baby carrier whereby the baby carrier is suspended from the bar to swing between the supports.

15 Claims, 9 Drawing Sheets

BABY CARRIER SWING CONVERSION SUPPORT DEVICE

CROSS-REFERENCE TO RELATED APPLICATIONS

This application is a continuation in part of application Ser. No. 14/022,346 filed Sep. 10, 2013.

BACKGROUND OF THE DISCLOSURE

Field of the Disclosure

The disclosure relates to support devices and more particularly pertains to a new support device for supporting an existing baby carrier in a position over a supporting surface while allowing the carrier to swing.

SUMMARY OF THE DISCLOSURE

An embodiment of the disclosure meets the needs presented above by generally comprising a bar having opposite ends. Each of a pair of supports is coupled to an associated one of the opposite ends of the bar for hanging an infant carrier from the bar between the supports. The supports and the bar define a stand. Each of a pair of hooks is coupled to and extends from the bar for receiving a handle of the baby carrier whereby the baby carrier is suspended from the bar to swing between the supports.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
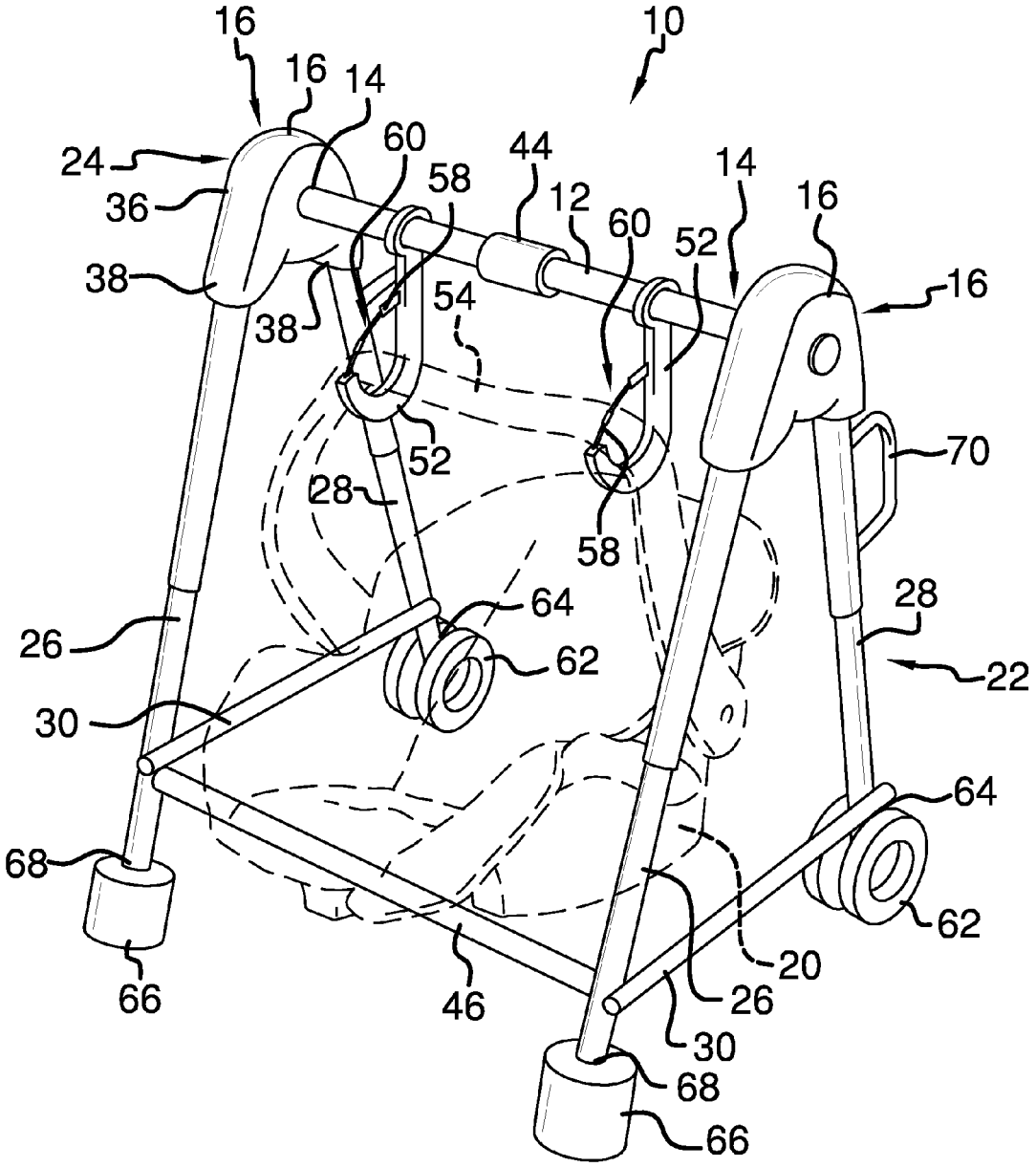
FIG. 1 is a top front side perspective view of a baby carrier swing conversion support device according to an embodiment of the disclosure.

With reference now to the drawings, and in particular to FIGS. 1 through 9 thereof, a new support device embodying the principles and concepts of an embodiment of the disclosure and generally designated by the reference numeral 10 will be described.

As best illustrated in FIGS. 1 through 9, the baby carrier swing conversion support device 10 generally comprises a bar 12 having opposite ends 14. Each of a pair of supports 16 is coupled to an associated one of the opposite ends 14 of the bar 12. The supports 16 hold the bar 12 over a supporting surface 18 such that the bar 12 is configured for hanging an infant carrier 20 from the bar 12 between the supports 16. The supports 16 and the bar 12 collectively define a stand 22.

Figure 5:
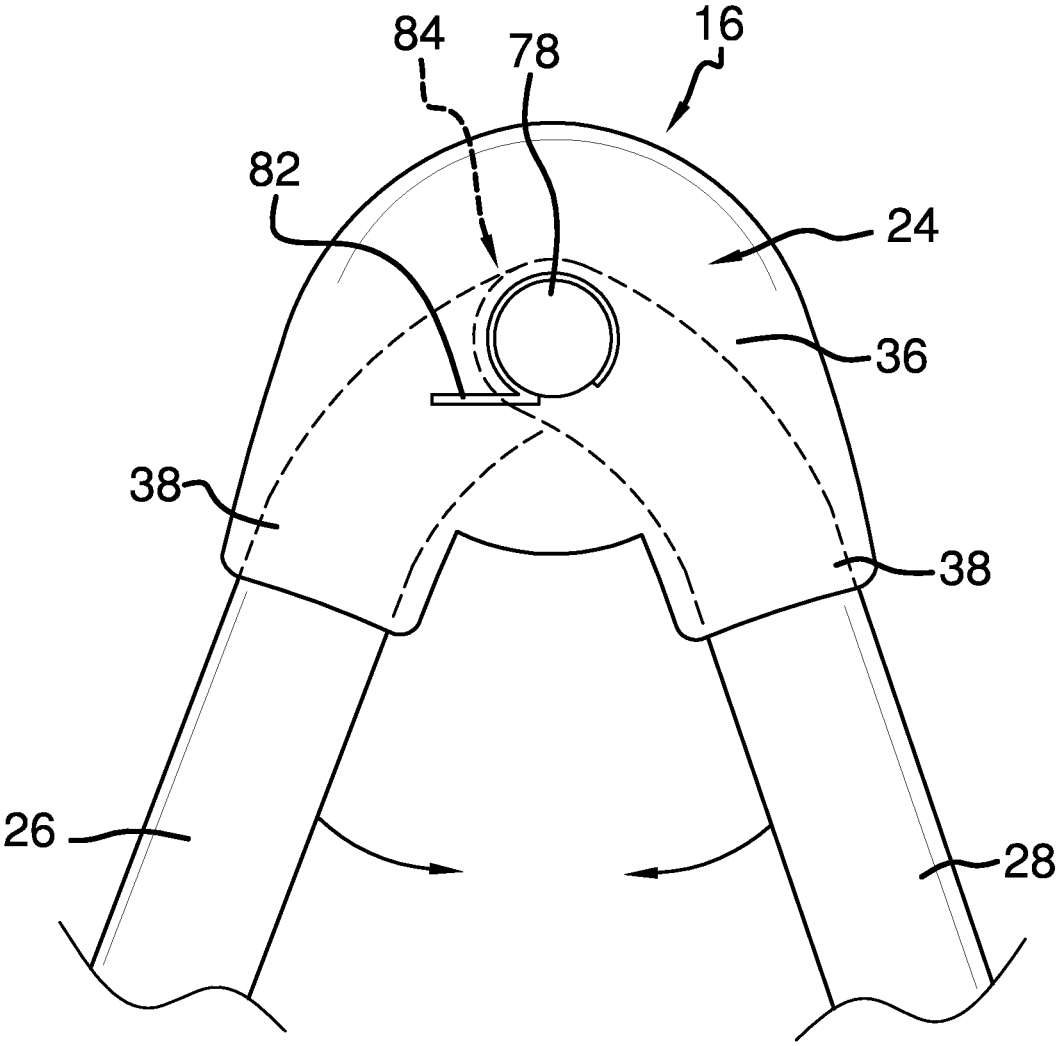
FIG. 5 is a side view of a support housing of an embodiment of the disclosure.

Each support 16 comprises a support housing 24 coupled to the associated one of the opposite ends 14 of the bar 12, a front leg 26 coupled to the support housing 24, and a back leg 28 coupled to the support housing 24. A brace 30 has a first end 32 pivotally coupled to one of the front leg 26 and the back leg 28. As shown, the first end 32 is coupled to the front leg 26. The brace 30 is positionable to extend between the front leg 26 and the back leg 28 wherein the brace 30 prevents pivoting of the front leg 26 relative to the back leg 28 when opposite ends 32,34 of the brace 30 engage the front leg 26 and the back leg 28, respectively. The support housing 24 may have a generally disc-shaped central section 36 from which the front leg 26 and back leg 28 extend. Each of a pair of projections 38 may be incorporated integrally from the central section 36 and may surround a respective one of the front leg 26 and the back leg 28 to strengthen support of the support housing 24 by the front leg 26 and back leg 28. In FIG. 5, the front leg 26 and back leg 28 are pivotable around a joint 84. The pivoting may be controlled by a clip 82 of conventional design. The construction may be of a conventional material such as aluminum steel, alloys, polyethylene, polypropylene, or the like.

Figure 2:
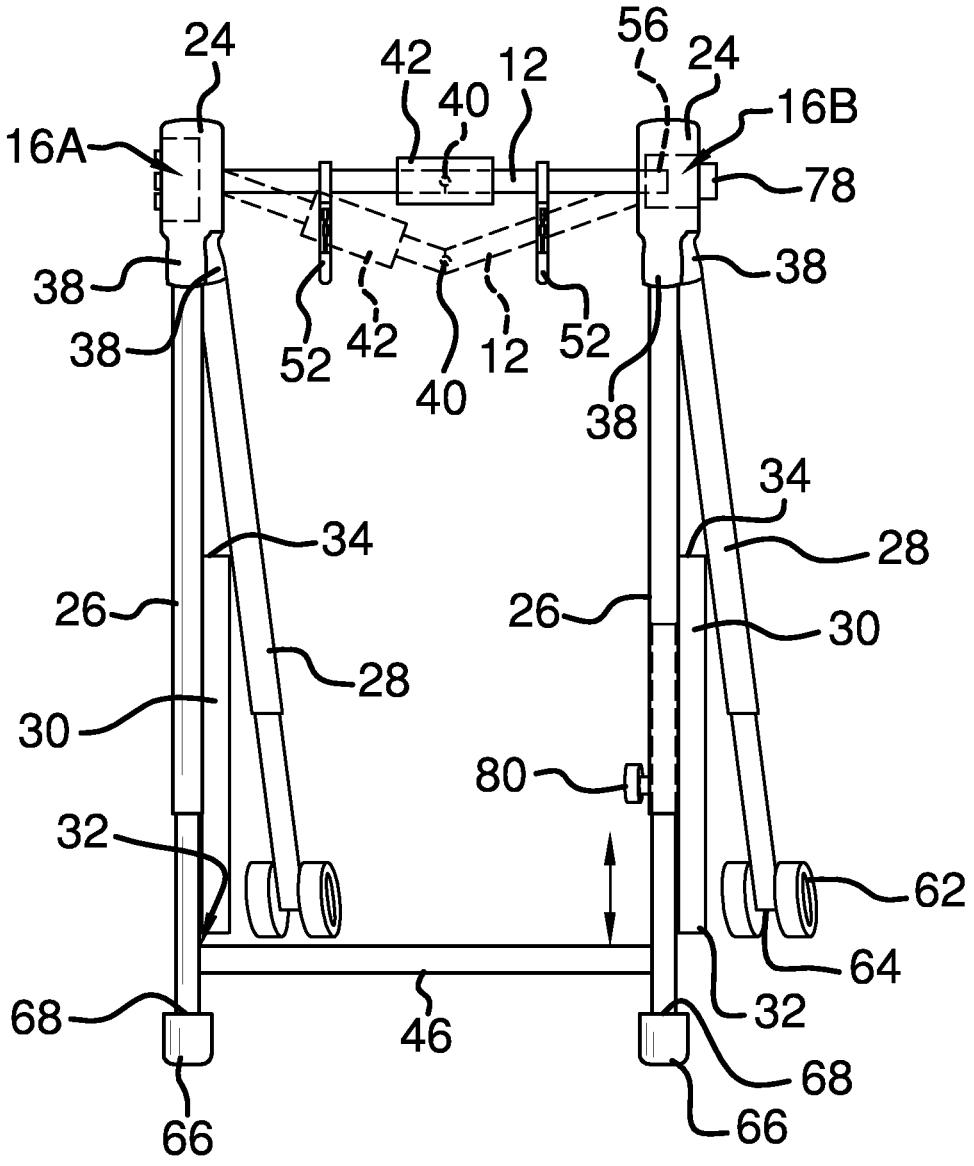
FIG. 2 is a front view of an embodiment of the disclosure.
Figure 3:
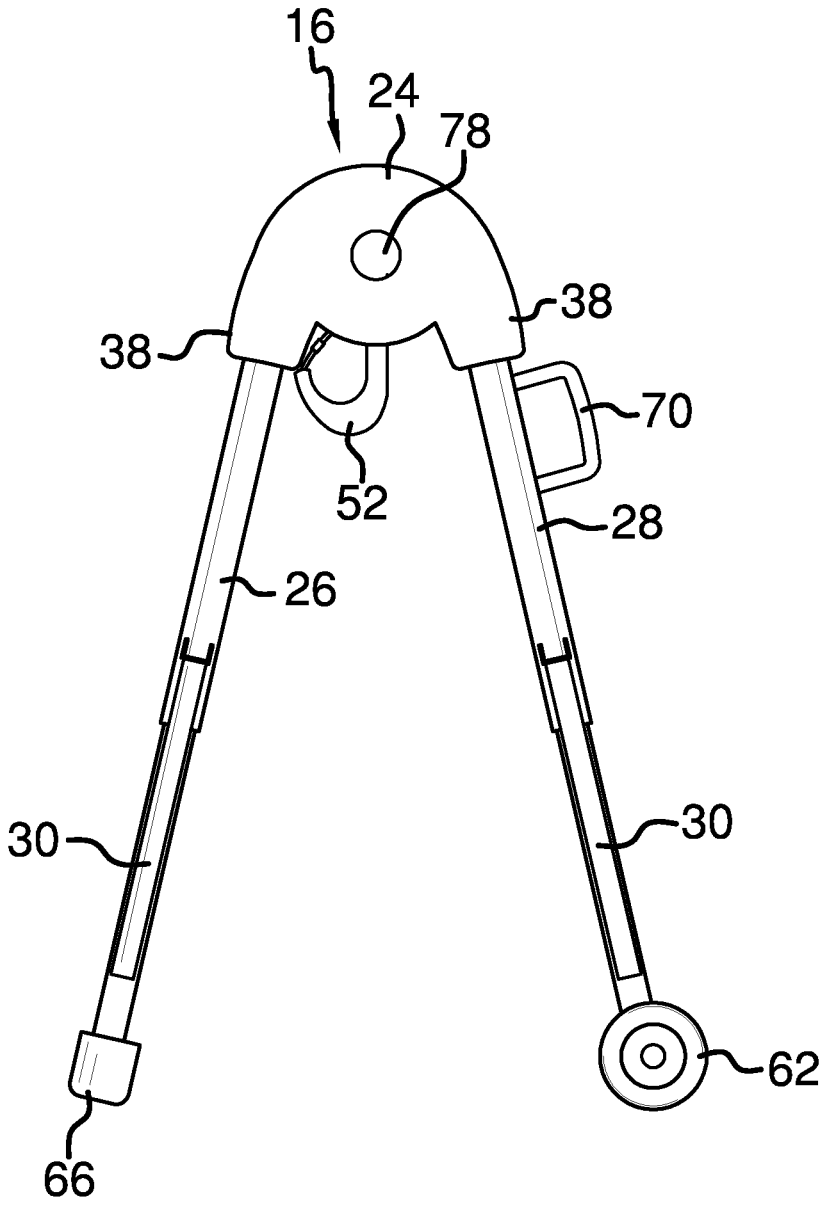
FIG. 3 is a side view of an embodiment of the disclosure.
Figure 4:
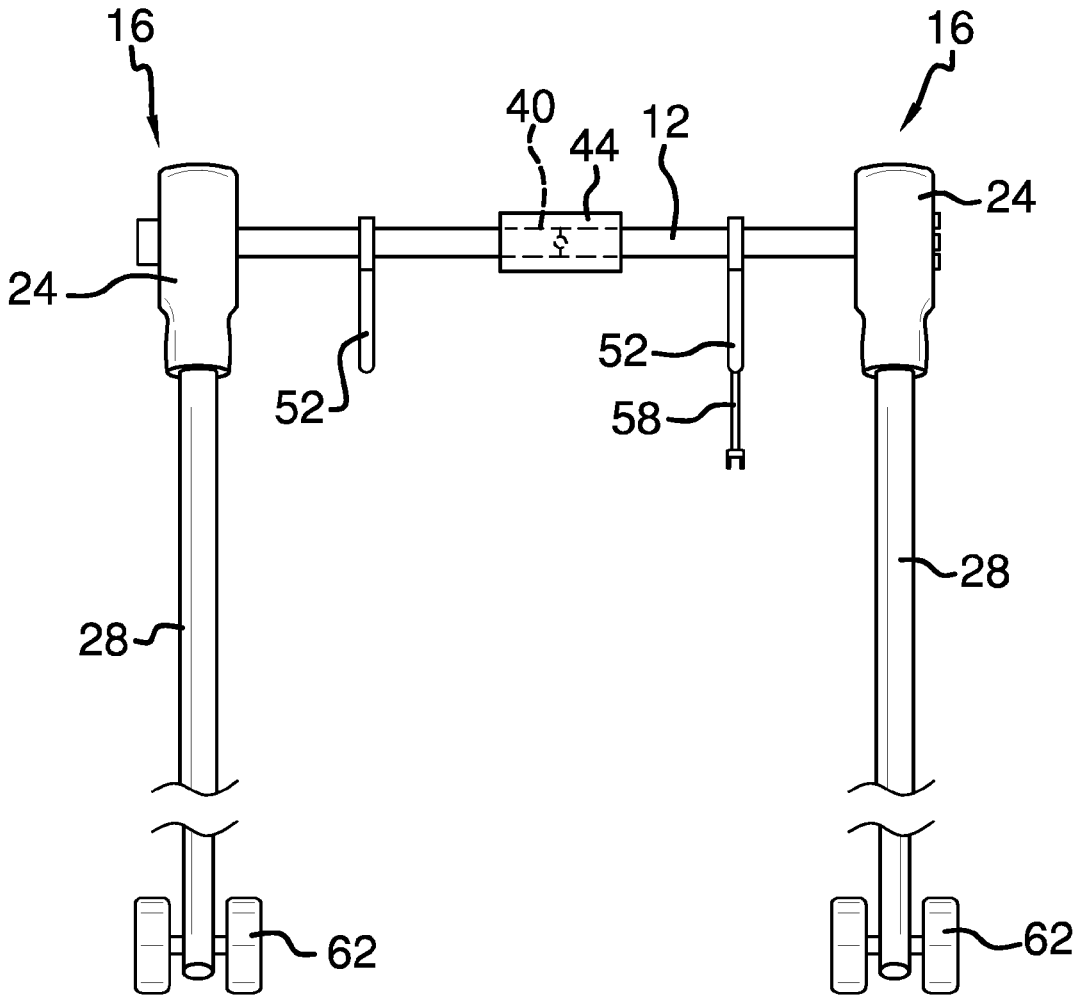
FIG. 4 is a back view of an embodiment of the disclosure.

As exemplified in the front leg 26 of one of the supports 16 in FIG. 2, each front leg 26 and back leg 28 may be telescopic in a conventional manner and locked into place using a release mechanism 80, such as a rotating knob frictionally engaging a nested leg section, in a conventional manner.

Figure 6:
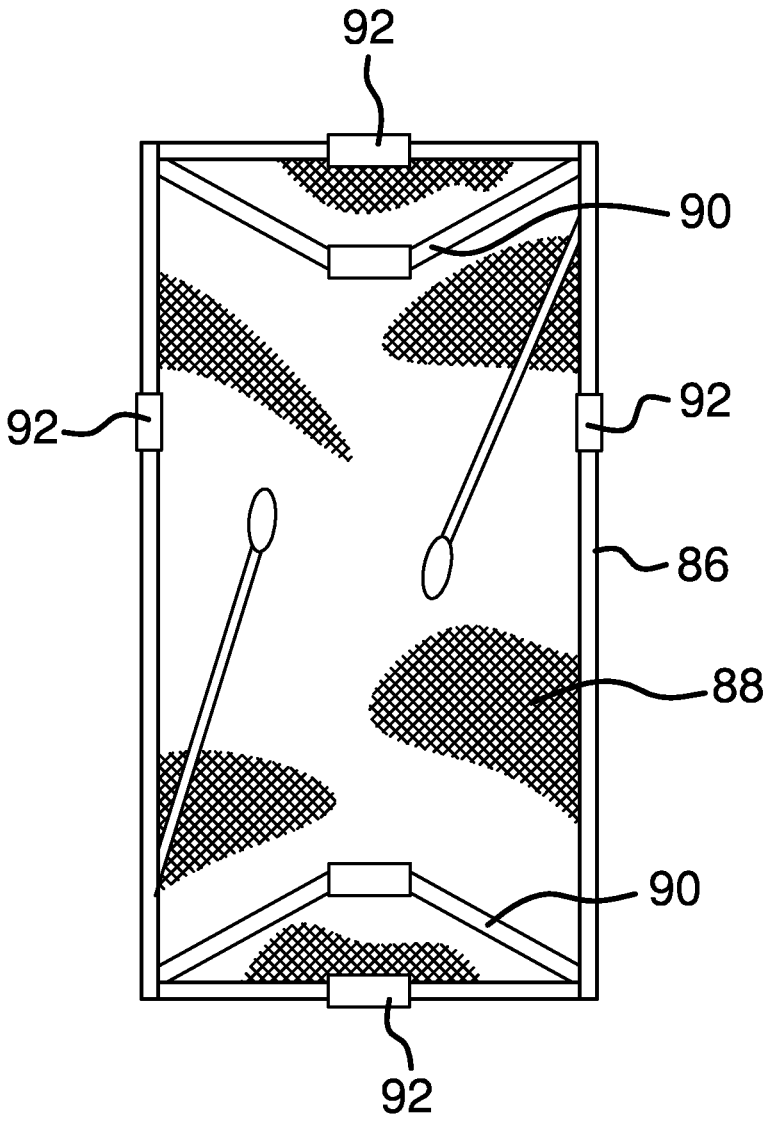
FIG. 6 is a top view of a frame of an embodiment of the disclosure.
Figure 7:
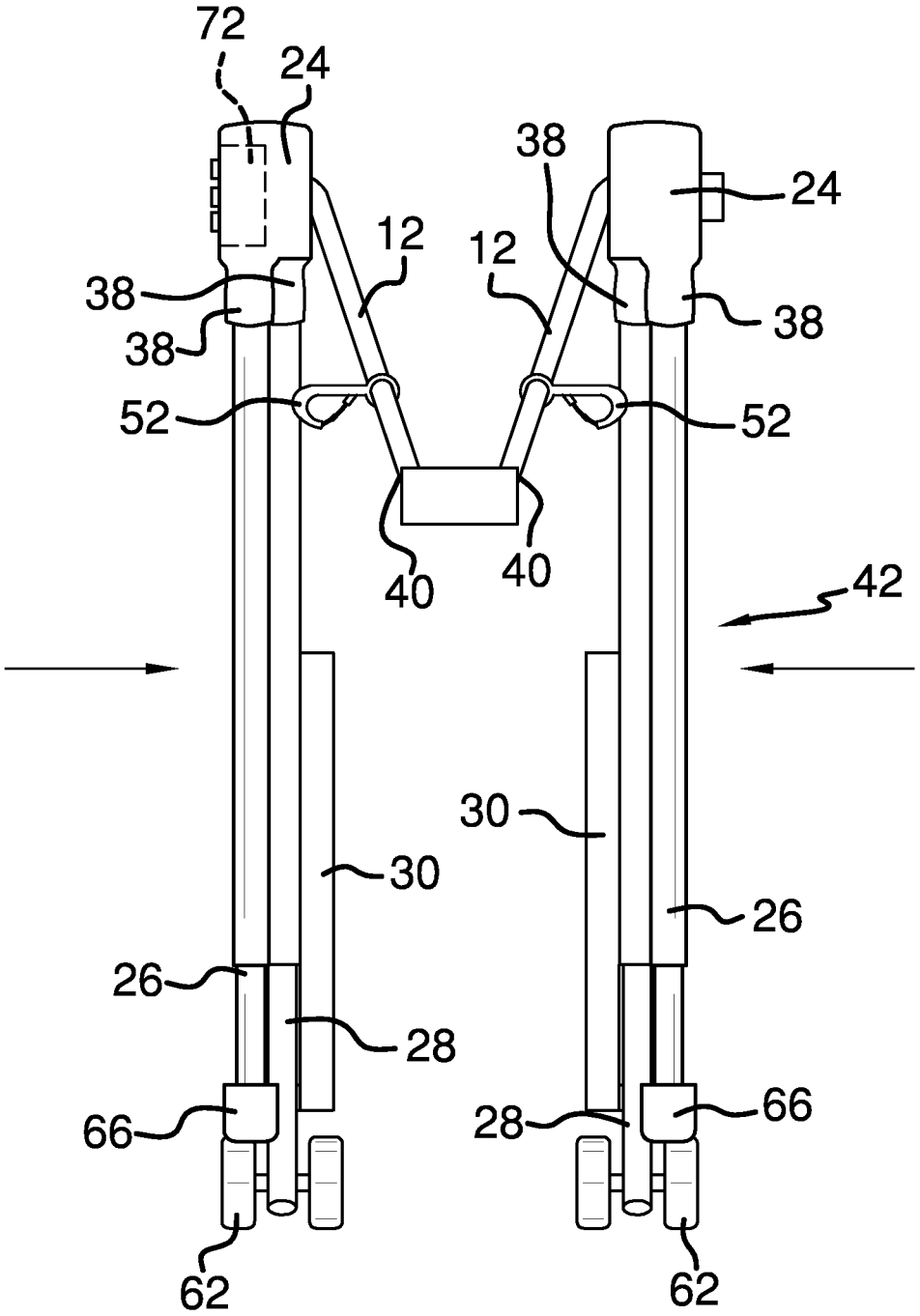
FIG. 7 is a front view of an embodiment of the disclosure in a partially collapsed position.
Figure 8:
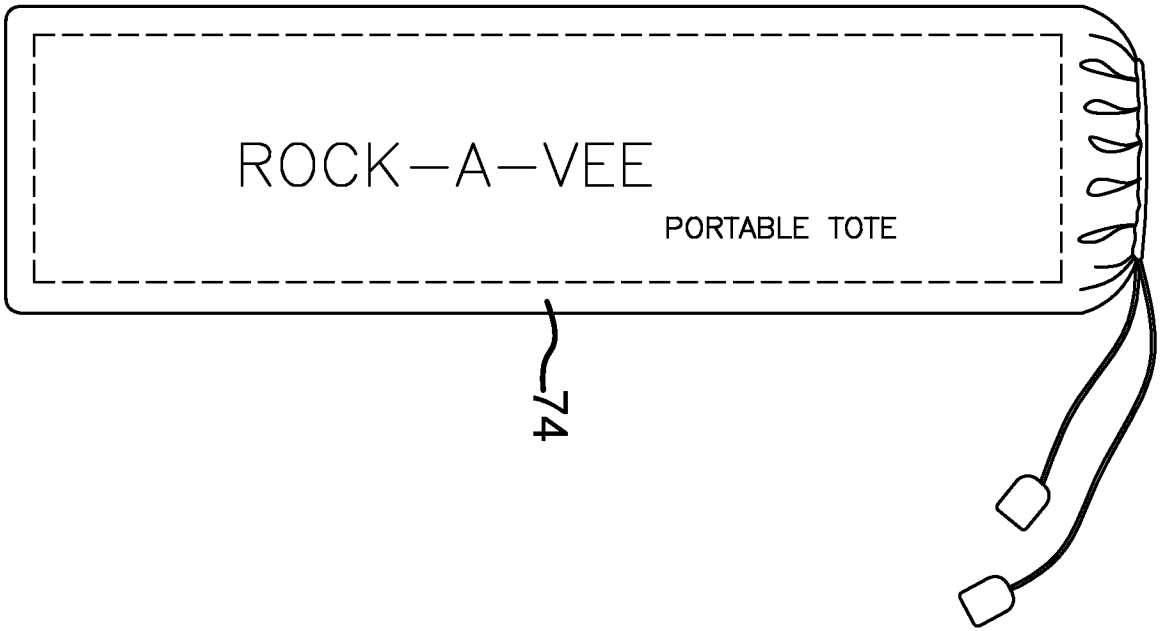
FIG. 8 is a front view of a carrying bag of an embodiment of the disclosure.

The bar 12 has a pivot point 40 wherein the bar 12 is collapsible such that the supports 16 are moved inwardly together defining a collapsed position 42 for the stand 42. Multiple pivot points 40 may also be employed as shown in FIG. 6. A collar 44 may be positioned on the bar 12 and securable to the bar 12 in a conventional manner to cover the pivot point 40 wherein the bar 12 is held in a linear orientation. The collapsed position 42 further comprises the front leg 26 of each support 16 being pivotable relative to the back leg 28 of the support 16 wherein each of the front leg 26 and the back leg 28 of the support 16 extend in parallel from the support housing 24 of the support 16. A stabilizer 46 is elongated and coupled to and extends between the pair of supports 16 spaced from the support housing 24. The collapsed position 42 further comprises the stabilizer 46 being disengageable from extending between the supports 16 and movable into a position parallel to the supports 16, substantially parallel more specifically to the front leg 26 and back leg 28. The stabilizer 46 may have a first section 48 pivotably coupled to a first one 16A of the supports 16 and a second section 50 pivotably coupled to a second one 16B of the supports 16. The first section 48 of the stabilizer 46 is coupled to the second section 50 of the stabilizer 46 to form the straight elongated strengthening the stand 22. The first section 48 of the stabilizer 46 is disengageable from the second section 50 of the stabilizer 46 for collapsing the stand 22.

Figure 9:
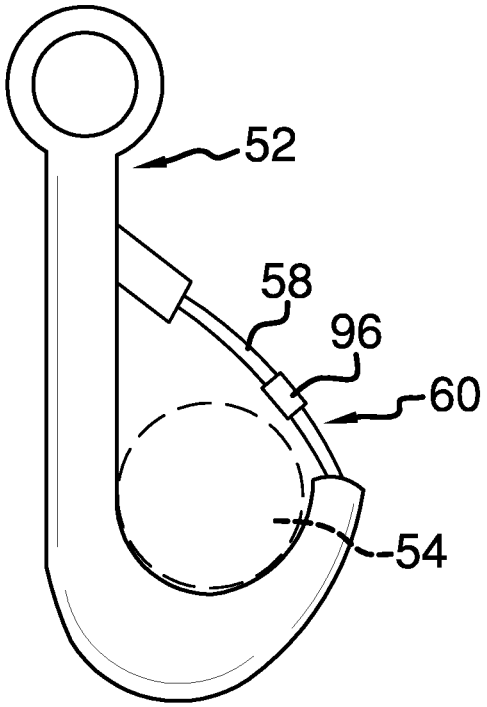
FIG. 9 is a side view of a support clip of an embodiment of the disclosure.

Each of a pair of hooks 52 is coupled to and extends from the bar 12. The hooks 52 are configured for receiving a handle 54 of the infant carrier 20 whereby the infant carrier 20 is suspended from the bar 12. A motor 56 activated by a control 78 is coupled to the stand 22 and may be more particularly positioned in one of the support housings 24. The motor 56 moves the bar 12 in a reciprocating rotational motion such that the bar 12 is configured to impart a swinging motion to the infant carrier 20 supported on the hooks 52. Alternatively, the motor 56 may be a spring mechanism which is wound using a knob in place of control 78 extending from one of the support housings 24. Each of a pair of straps 58, as represented in FIG. 9, is coupled to an associated one of the hooks 52. Each of the straps 58 is positionable to extend across a gap 60 of an associated one of the hooks 52 wherein each strap 58 is configured to inhibit disengagement of the handle 54 of the infant carrier 20 from the associated hook 52. A respective buckle 96 or the like may be used to secure each strap 58.

FIG. 6 shows a frame 86 which may be used to support the infant carrier 20 or used in place of the infant carrier 20 to directly support a child from hooks 52. Mesh 88 is coupled to the frame 86 and the frame 86. Frame straps 90 may be used to couple the frame 86 to the hooks 52. Folding points 90 of conventional design may be provided on the frame 86 to facilitate compact storage.

Each of a pair of wheels 62 is coupled to a distal end 64 of an associated one of the rear legs 28 relative to the bar 12 to facilitate moving the stand 22. Each of a pair of feet 66 is coupled to a distal end 68 of an associated one of the front legs 26 to hold the stand 22 in a stable static position during use. The positioning of the wheels 62 and feet 66 may be reversed relative to the front legs 26 and rear legs 28.

A grip 70 is coupled to the stand 22 facilitating carrying of the stand 22. The grip 70 may be coupled to one of the supports 16 and more specifically, coupled to one of the front legs 26 or the back legs 28. An audio player 72 of otherwise conventional design may be coupled to the stand 22. The audio player 72 may be positioned in one of the support housings 24, typically in the support housing 24 not housing the motor 56. A carrying bag 74 of conventional design may also be provided. The stand 22 is positionable in the carrying bag 74 when the stand 22 is in the collapsed position 42. The carrying bag 74 may having an elongated generally cylindrical shape as the collapsed position 42 has a generally elongated linear orientation.

In use, the device 10 creates a swing utilizing the existing infant carrier 20. The stand 22 is set up on the supporting surface 18. The handle 54 of the infant carrier 20 is placed in the hooks 52. The motor 56 is activated to impart a swinging motion to the infant carrier 20. The audio player 72 is also activated if desired. The stand 22 may be collapsed and carried by the grip 70 or stored and carried in the carrying bag 74.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A baby carrier swing conversion support device for holding a baby carrier in a manner allowing the baby carrier to swing, the device comprising:

a bar having opposite ends;

a pair of supports, each of said supports being coupled to an associated one of said opposite ends of said bar wherein said bar is configured for hanging an infant carrier from said bar between said supports, said supports and said bar defining a stand, each said support comprising a support housing coupled to said associated one of said opposite ends, a front leg coupled to said support housing, and a back leg coupled to said support housing;

a pair of hooks, each of said hooks being coupled to and extending from said bar, wherein said hooks are configured for receiving a handle of the baby carrier whereby said baby carrier is suspended from said bar;

a pair of wheels, each of said wheels being coupled to a distal end of an associated one of said rear legs relative to said bar;

a pair of straps, each of said straps being coupled to an associated one of said hooks, each of said straps being positionable to extend across a gap of an associated one of said hooks wherein each said strap is configured to inhibit disengagement of the handle of the carrier from said associated hook; and said bar having a pivot point wherein said bar is collapsible such that said supports are moved inwardly together defining a collapsed position for said stand.

2. The device of claim 1, further comprising a stabilizer, said stabilizer being elongated, said stabilizer being coupled to and extending between said pair of supports.

3. The device of claim 1, further comprising a pair of feet, each of said feet being coupled to a distal end of an associated one of said front legs.

4. The device of claim 1, further comprising a grip coupled to said stand.

5. The device of claim 4, further comprising said grip being coupled to one of said supports.

6. The device of claim 1, further comprising an audio player coupled to said stand.

7. The device of claim 1, further comprising said bar having a pair of pivot points wherein said bar is collapsible such that said supports are moved inwardly together defining a collapsed position for said stand.

8. The device of claim 7, further comprising said collapsed position further comprising said front leg of each support being pivotable relative to said back leg of said support wherein each of said front leg and said back leg of said support extend in parallel from said housing of said support.

9. The device of claim 8, further comprising:

a stabilizer, said stabilizer being elongated, said stabilizer extending between said pair of supports; and said collapsed position further comprising said stabilizer being disengageable from extending between said supports and movable into a position parallel to said supports.

10. The device of claim 9, further comprising a carrying bag, said stand being positionable in said carrying bag when said stand is in said collapsed position.

11. The device of claim 1, further comprising a motor coupled to said stand, said motor moving said bar in a reciprocating rotational motion such that said bar is configured to impart a swinging motion to the carrier supported on said hooks.

12. The device of claim 1, further comprising:

a motor coupled to said stand, said motor moving said bar in a reciprocating rotational motion such that said bar is configured to impart a swinging motion to the carrier supported on said hooks; and said motor being positioned in an associated one of said support housings.

13. The device of claim 2, further comprising said stabilizer having a first section pivotably coupled to a first one of said supports, said stabilizer having a second section pivotably coupled to a second one of said supports, said first section of said stabilizer being coupled to said second section of said stabilizer, said first section of said stabilizer being disengageable from said second section of said stabilizer for collapsing said stand.

14. The device of claim 8, wherein each support further comprises a brace, said brace having a first end pivotally coupled to one of said front leg and said back, said brace being positionable to extend between said front leg and said back leg wherein said brace prevents pivoting of said front leg relative to said back leg when opposite ends of said brace engage said front leg and said back leg.

15. A baby carrier swing conversion support device for holding a baby carrier in a manner allowing the baby carrier to swing, the device comprising:

a bar having opposite ends;

a pair of supports, each of said supports being coupled to an associated one of said opposite ends of said bar wherein said bar is configured for hanging an infant carrier from said bar between said supports, said supports and said bar defining a stand, each said support comprising a support housing coupled to said associated one of said opposite ends, a front leg coupled to said support housing, a back leg coupled to said support housing, a brace, said brace having a first end pivotally coupled to one of said front leg and said back, said brace being positionable to extend between said front leg and said back leg wherein said brace prevents pivoting of said front leg relative to said back leg when opposite ends of said brace engage said front leg and said back leg;

said bar having a pivot point wherein said bar is collapsible such that said supports are moved inwardly together defining a collapsed position for said stand, said collapsed position further comprising said front leg of each support being pivotable relative to said back leg of said support wherein each of said front leg and said back leg of said support extend in parallel from said housing of said support;

a stabilizer, said stabilizer being elongated, said stabilizer being coupled to and extending between said pair of supports, said collapsed position further comprising said stabilizer being disengageable from extending between said supports and movable into a position parallel to said supports, said stabilizer having a first section pivotably coupled to a first one of said supports, said stabilizer having a second section pivotably coupled to a second one of said supports, said first section of said stabilizer being coupled to said second section of said stabilizer, said first section of said stabilizer being disengageable from said second section of said stabilizer for collapsing said stand;

a pair of hooks, each of said hooks being coupled to and extending from said bar, wherein said hooks are configured for receiving a handle of the baby carrier whereby said baby carrier is suspended from said bar;

a motor coupled to said stand, said motor moving said bar in a reciprocating rotational motion such that said bar is configured to impart a swinging motion to the carrier supported on said hooks, said motor being positioned in an associated one of said support housings;

a pair of straps, each of said straps being coupled to an associated one of said hooks, each of said straps being positionable to extend across a gap of an associated one of said hooks wherein each said strap is configured to inhibit disengagement of the handle of the carrier from said associated hook;

a pair of wheels, each of said wheels being coupled to a distal end of an associated one of said rear legs relative to said bar;

a pair of feet, each of said feet being coupled to a distal end of an associated one of said front legs;

a grip coupled to said stand, said grip being coupled to one of said supports;

an audio player coupled to said stand; and a carrying bag, said stand being positionable in said carrying bag when said stand is in said collapsed position.

* * * * *